United States Patent [19]

Gierse et al.

[11] Patent Number: 4,621,440

[45] Date of Patent: Nov. 11, 1986

[54] CONVECTION DRYER AND/OR FIXING MACHINE

[75] Inventors: Franz-Josef Gierse, Siegen; Heinrich Hermanns, Korschenbroich; Werner Hermes, Tönisvorst; Gerhard Lüpnitz, Mönchen-Gladbach; Manfred Pabst, Cologne; Heribert Schlicht, Mönchen-Gladbach; Franz-Josef Schroer, Erkelenz, all of Fed. Rep. of Germany

[73] Assignee: A. Monforts GmbH & Co., Monchen-Gladbach, Fed. Rep. of Germany

[21] Appl. No.: 658,546

[22] Filed: Oct. 9, 1984

[30] Foreign Application Priority Data

Oct. 6, 1983 [DE] Fed. Rep. of Germany ..... 3336331

[51] Int. Cl.[4] ..... F26B 13/02

[52] U.S. Cl. ..... 34/155; 34/158; 34/160; 34/49

[58] Field of Search ..... 34/155, 156, 160, 158, 34/49, 54

[56] References Cited

U.S. PATENT DOCUMENTS 3,851,408 12/1974 Lojek et al. ..... 34/155

4,094,074 6/1978 Schrader et al. ..... 34/158

*Primary Examiner*—Larry I. Schwartz

*Attorney, Agent, or Firm*—Herbert L. Lerner; Laurence A. Greenberg

[57] ABSTRACT

A convection drying and/or fixing machine for the thermal treatment of a textile fabric web with a treatment gas includes nozzle boxes above and below the fabric web extending across the width of the fabric web, the nozzle boxes having inlet openings with a given size and shape for receiving the treatment gas and outlet openings for directing the treatment gas onto the fabric web, a pressure chamber directly adjacent the inlet openings for directing the treatment gas into the inlet openings of the nozzle boxes, the pressure chamber having bypass openings with substantially the given size and shape, each of the bypass openings being adjacent a respective one of the inlet openings forming a respective pair of openings, a return flow chamber receiving the treatment gas directly from the bypass opening and circulating the treatment gas to the pressure chamber, and common bypass flaps each being disposed at a respective one of the pair of openings for at least partially closing the openings of the respective pair of openings.

5 Claims, 1 Drawing Figure

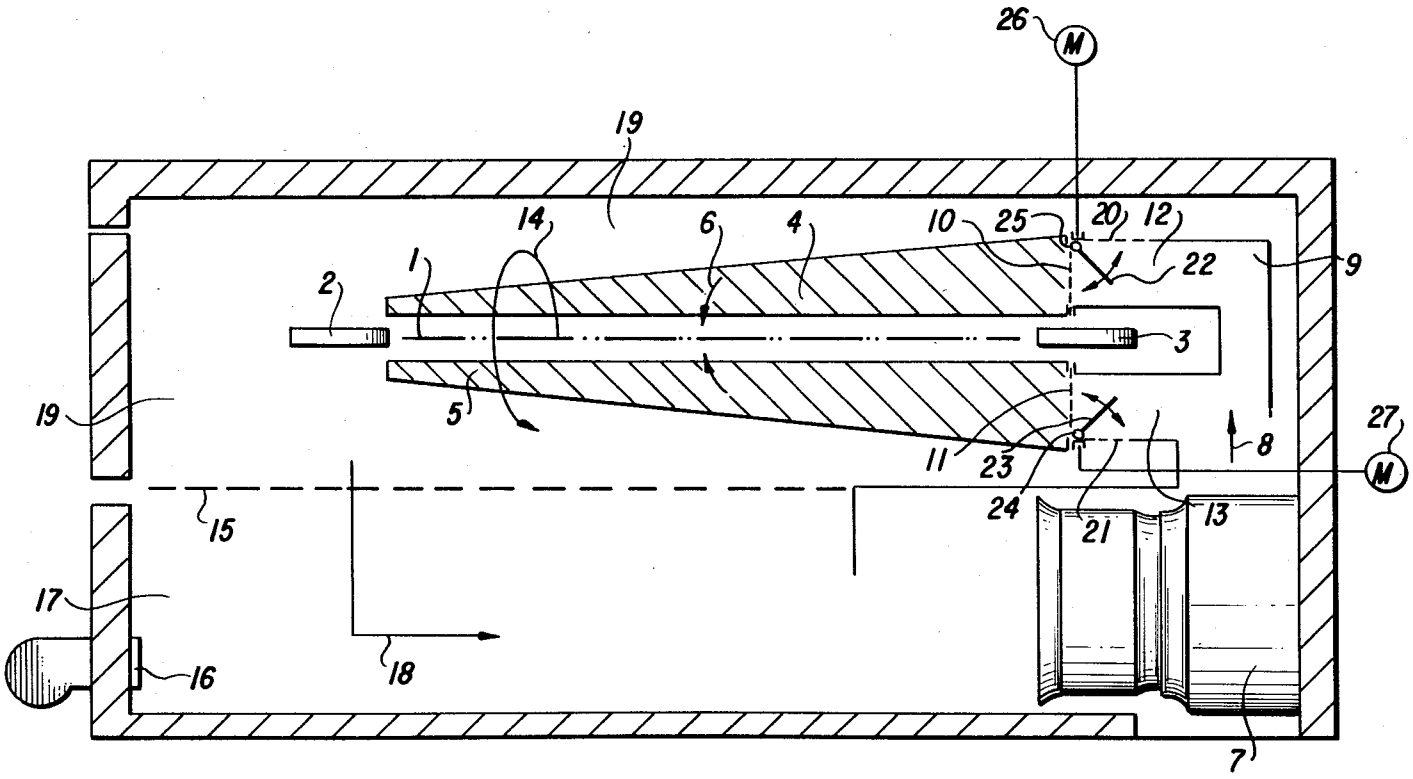
27
M
9
8
7
13
22
3
12
20
21
M
26
25
23
24
10
11
4
6
19
14
5
1
18
2
15
16
19
17

CONVECTION DRYER AND/OR FIXING MACHINE

The invention relates to a convection drying and/or fixing machine for the thermal treatment of a widthwise-guided textile fabric web with a treatment gas, including nozzle boxes disposed above and below the fabric web extended across the width of the fabric web, a pressure chamber connected to the nozzle boxes, and a return flow chamber adjacent the nozzle boxes for circulating the treatment gas to a pressure chamber. The heat treatment machine is preferably a stenter or loop-drying or fixing machine, such as a tentering or stretching frame, a wire cloth or machine band dryer, a hot flue or the like. The term "circulating air stream" includes any gas used in machines of this type.

In gas-heated machines of the above-mentioned type, the burners must be turned down during a stoppage of the transport band, and at the same time the circulating air stream must be throttled, such as with the aid of throttle valves at the suction side. In this way the temperature of the circulating gas is lowered. When the machine is started again, the heating "under load" usually cannot be carried out as quickly as the acceleration of the web. This is the cause of insufficient fixing or other treatment of a part of the goods which is too weak.

In oil-heated, or steam-heated machines, the circulating air stream is also throttled and the energy supply is stopped when the transport band stands still. Since there is no heat energy taken from the air heaters, the temperature of the heating surfaces can sharply increase due to the accumulated heat. Consequently, as the machine is started again the temperature of the circulating air stream rises above the specified normal value, and overheating and especially over-fixing and the formation of stripes on the fabric web may result.

It is accordingly an object of the invention to provide a convection drying and/or fixing machine which overcomes the hereinafore-mentioned disadvantages of the heretofore-known devices of this general type, which prevents the formation of stripes due to stopping and restarting of the machine which become especially pronounced with knitted goods, and which improves the machine in this respect.

With the foregoing and other objects in view, a thermo-installation of the above-mentioned type, with nozzle boxes connected to a pressure chamber and a return flow chamber connected to the nozzle boxes, there is provided, in accordance with the invention, a convection drying and/or fixing machine for the thermal or heat treatment of a textile fabric web with a treatment gas, comprising nozzle boxes above and below the fabric web extended across the width of the fabric web, the nozzle boxes having inlet openings with a given size and shape for receiving the treatment gas and outlet openings for directing the treatment gas onto the fabric web, a pressure chamber directly adjacent the inlet openings for directing the treatment gas into the inlet openings of the nozzle boxes, the pressure chamber having bypass openings with substantially the given size and shape, each of the bypass openings being adjacent a respective one of the inlet openings forming a respective pair of openings, a return flow chamber receiving the treatment gas directly from the bypass opening and circulating the treatment gas to the pressure chamber, and common bypass flaps or shutters each being disposed at a respective one of the pair of openings for at least partially or completely closing the openings of the respective pair of openings.

The achievement of the invention is that during a stoppage of the fabric web, the temperature of the circulating air stream can be kept constant at the value set for normal operation, without having the circulating air stream coming in contact with the goods. Throttling valves for the pressure chambers or blowers at the suction side, are consequently not required. When the web is not moving, the inlets of the nozzle boxes can be automatically closed by operating the bypass flaps. Therefore, the supply to the nozzle boxes or to the nozzles acting on the web is blocked, and the circulating air stream is conducted through the bypass openings associated with the respective nozzle boxes directly into the return flow chamber of the machine. Marks on the goods due to the stopping of the machine or over-drying can no longer occur.

Basically, the bypass flaps can be constructed in such a way that the bypass openings are closed in the operating condition and the inlet cross section of the adjacent nozzle box is open, whereas in the non-operating or stopped condition, the flaps open the bypass openings and close the adjacent nozzle box inlets. It is also advantageous to control or regulate the drive or drives of the bypass flaps in such a way that intermediate positions can also be set. In this way, the nozzle pressure can be continuously regulated from zero to the maximum pressure, or for instance, it is possible to only treat the top or bottom of the fabric with the circulating gas. While it is very often sufficient to provide a common drive for the bypass flaps, in the case of divided regulation of the bypass flaps for the top and bottom of the fabric web, suitably separated drives are required. Therefore, in accordance with another feature of the invention, each of the nozzle boxes is disposed at a respective side of the fabric web, and including separate drives each being connected to a respective one of the flaps for one of the nozzle boxes for selectively partly and completely closing off and redirecting the circulating treatment gas.

In accordance with a further feature of the invention, the drives are controllable and switchable for opening the inlet openings and closing the bypass openings during normal operation of the machine, and for closing the inlet openings and opening the bypass openings when the machine is stopped.

In accordance with an additional feature of the invention, the inlet opening and bypass opening of each pair of openings define a border therebetween, and each of the flaps has a hinge axis disposed at a respective one of the borders.

In accordance with a concomitant feature of the invention each of the flaps infinitely or steplessly adjusts nozzle pressure onto one of the sides of the fabric web.

Other features which are considered as characteristic for the invention are set for th in the appended claims.

Although the invention is illustrated and described herein as embodied in a convection dryer and/or fixing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a diagrammatic, cross-sectional view of a stenter or tentering frame according to the invention.

Referring now to the drawing in detail, it is seen that it represents a vertical-sectional view perpendicular to the longitudinal direction of a stenter or tentering frame. During the operation of the stenter or tentering or stretching frame, a fabric web 1 is held in chains 2 and 3 at its longitudinal edges and is moved in a direction perpendicular to the plane of the drawing between nozzle boxes 4 and 5. The nozzle boxes are disposed above and below the fabric web 1 transverse to the transport direction of the web. The nozzle boxes are provided with holes or slots for blowing gas used for treating the web in the direction of an arrow 6 from the top and from the bottom onto the fabric web 1. The gas used for the treatment is transported in the direction of an arrow 8 by a blower 7 into a pressure chamber 9 which is disposed upstream of the nozzle boxes 4 and 5 and during the normal operation of the machine the gas flows into the nozzle boxes 4 and 5 through outlets 12 and 13 of the pressure chamber 9.

The gas flows from the pressure chamber 9 onto the fabric web 1 in the direction of the arrow 6, and the gas is conducted in the direction of an arrow 14 from the fabric web to a return flow chamber 19 of the machine. From the return flow chamber 19, the gas may travel through a lint, thread end or fluff screen 15 and through a heating chamber 17 which is directly heated by a gas burner 16 in direction of an arrow 18 to the suction side of the blower 7.

If the transport of the web 1 during the operation of the stenter or tentering frame is braked or stopped without any special precautions being taken in the conventional type of machinery, stripes which are caused by the standstill form on the web during the stopping and/or restarting of the web movement. In order to avoid this disadvantage, bypass openings 20 and 21 are provided in the pressure chamber 9, closely adjacent inlets 10 and 11 of the nozzle boxes 4 and 5, which lead directly to the return flow chamber 19 of the machine. The bypass openings 20, 21 should have the same shape and size as the adjacent nozzle box inlets 10, 11 or they should have the same cross sectional area. The bypass openings 20, 21 should be able to close with the help of bypass shutters or flaps 22, 23 having hinged axes 24, 25. The axes may lie in the border region between the nozzle box inlets 10, 11 and the bypass openings 20, 21 or they may form the border between the inlets 10, 11 and the openings 20, 21, respectively.

The bypass flaps 22, 23 are provided with motor drives 26, 27, or they may be provided with a common drive apparatus in such a way that dependent on the need or machine requirement, the bypass openings 20, 21 may be completely closed (during the normal operation of the machine), or the nozzle box inlets 10, 11 may be closed (when the motion of the web is stopped). In the first case, all of the circulating air is blown from the pressure chamber 9 through the nozzle boxes onto the fabric web 1, and from there it is conducted back through the return flow chamber 19, the lint filter 15 and the heating chamber 17 to the blower 7. In the second case, the air is transported from the blower 7 into the pressure chamber 9, and through the bypass openings 20, 21 through which it is directly returned into the return flow chamber 19 and from there in the normal way to the blower. In this way, the air temperature can be kept constant, so that when the machine is started again and the nozzle inlets 10, 11 are opened, treatment gas of the proper temperature and quantity is immediately available. Consequently, stripes caused by the standstill of the web cannot form, either when stopping or when starting the machine again.

The foregoing is a description corresponding in substance to German Application No. P 33 36 331.5, dated Oct. 6, 1983, the International priority of which is being claimed for the instant application, and which is hereby made part of this application. Any material discrepancies between the foregoing specification and the aforementioned corresponding German application are to be resolved in favor of the latter.

We claim:

1. Convection drying and/or fixing machine for the thermal treatment of a textile fabric web with a treatment gas, comprising nozzle boxes above and below the fabric web extended across the width of the fabric web, said nozzle boxes having inlet openings with a given size and shape for receiving the treatment gas and outlet openings for directing the treatment gas onto the fabric web, a pressure chamber directly adjacent said inlet openings for directing the treatment gas into said inlet openings of said nozzle boxes, said pressure chamber having bypass openings with substantially said given size and shape, each of said bypass openings being adjacent a respective one of said inlet openings forming a respective pair of openings, a return flow chamber receiving the treatment gas directly from said bypass opening and circulating the treatment gas to said pressure chamber, common bypass flaps each being disposed at a respective one of said pair of openings, and means for moving each of said bypass flaps between a first position closing a respective one of said bypass openings and a second position closing a respective one of said inlet openings and bypassing the fabric web.

2. Machine according to claim 1, wherein each of said nozzle boxes is disposed at a respective side of the fabric web, and said moving means include separate drives each being connected to a respective one of said flaps for one of said nozzle boxes for selectively partly and completely closing off and redirecting the circulating treatment gas.

3. Machine according to claim 2, wherein said drives are controllable for opening said inlet openings and closing said bypass openings during normal operation of the machine, and for closing said inlet openings and opening said said bypass openings when the machine is stopped.

4. Machine according to claim 1, wherein said inlet opening and bypass opening of each pair of openings define a border therebetween, and each of said flaps has a hinge axis disposed at a respective one of said borders.

5. Machine according to claim 2, wherein each of said flaps infinitely adjusts nozzle pressure onto one of the sides of the fabric web.

* * * * *